US005600896A

United States Patent [19]

Lin

[11] Patent Number: 5,600,896

[45] Date of Patent: Feb. 11, 1997

[54] APPARATUS FOR DRYING AND STERILIZING KITCHEN UTENSILS

[76] Inventor: Yeong S. Lin, No. 16, Wu Chyuan 5 Rd., Wuku Ind'l Park, Taipei Hsien, Taiwan

[21] Appl. No.: 439,342

[22] Filed: Jul. 10, 1995

[51] Int. Cl.[6] ..... F26B 19/00

[52] U.S. Cl. ..... 34/60; 34/107

[58] Field of Search ..... 34/60, 61, 218, 34/380, 389, 219, 516, 107; 422/28

[56] References Cited

U.S. PATENT DOCUMENTS 5,433,919 7/1995 Baltes ..... 422/1

*Primary Examiner*—Henry A. Bennett
*Assistant Examiner*—Dinnatia Doster
*Attorney, Agent, or Firm*—Pro-techtor International

[57] ABSTRACT

An apparatus for drying and sterilizing kitchen utensils including two door panels with axial compression means at two opposite ends respectively moved in sliding grooves on the apparatus base relative to respective roller means at the sliding grooves, clamps adjustably fastened to tracks on an utensil carrying rack inside the apparatus base for holding down kitchen utensils, supporting tubes connected to stub tubes on the rack for holding containers upside-down for drying and sterilizing, and air conduits with air outlets for guiding hot currents of ozone to the rack and the supporting tubes in all directions.

2 Claims, 12 Drawing Sheets

APPARATUS FOR DRYING AND STERILIZING KITCHEN UTENSILS

BACKGROUND OF THE INVENTION

The present invention relates to kitchen utensil drying and sterilizing apparatus for drying and sterilizing kitchen utensils, bottles, cans, small containers, etc. The apparatus comprises two door panels with axial compression means at two opposite ends respectively moved in sliding grooves on the apparatus base relative to respective roller means at the sliding grooves, clamps adjustably fastened to tracks on an utensil carrying racks inside the apparatus base for holding down kitchen utensils, supporting tubes connected to stub tubes for holding containers upside-down for drying and sterilizing, and air conduits with air outlets for guiding hot currents of ozone to the rack and the supporting tubes in all directions.

When kitchen utensils such as bowls, dishes, trays, spoons, cups, bottles, food containers, etc., are washed with water, they must be dried before use. Various apparatus have been disclosed for this purpose, and have appeared on the market. These apparatus commonly have a door for controlling the entrance. This door is comprised of two symmetrical door panels disposed at two opposite sides, each having two circularly raised portions at two opposite ends respectively inserted into a respective sliding groove on the apparatus base (housing). If the size of the circularly raised portions does not match with the size of the sliding grooves perfectly, the door panels will be stuck. Another drawback of conventional kitchen utensil drying apparatus is that they can only heat dry kitchen utensils but have no means to sterilize kitchen utensils while drying. Furthermore, because these kitchen utensil drying apparatus use only a rack to carry kitchen utensils and have no means to hold them in place, and therefore kitchen utensils cannot be fully dried when they are put together. More particularly when bottles or other containers are put on the rack for drying, hot currents of air cannot be efficiently guided into the bottles or containers to fully dry the inside of the bottles or containers.

SUMMARY OF THE INVENTION

The present invention has been accomplished to provide an apparatus for drying and sterilizing kitchen utensils which eliminates the aforesaid drawbacks.

According to one aspect of the present invention, the apparatus comprises an electric heater and an ozone generator controlled to dry and sterilize kitchen utensils. According to another aspect of the present invention, the apparatus comprises two door panels with axial compression means at two opposite ends respectively moved in sliding grooves on the apparatus base relative to respective roller means at the sliding grooves, therefore the door panels can be conveniently opened and closed. According to still another aspect of the present invention, the apparatus comprises a plurality of clamps adjustably fastened to tracks on an utensil carrying rack inside the apparatus base for holding down kitchen utensils on the rack for drying and sterilizing. According to still another aspect of the present invention, the apparatus comprises a plurality of supporting tubes connected to stub tubes on the rack for holding containers upside-down for drying and sterilizing, and air conduits with air outlets for guiding hot currents of ozone to the rack and the supporting tubes in all directions.

BRIEF DESCRIPTION OF THE DRAWINGS

FIG. 3-1 is a sectional view showing an axial compression means installed and the compression spring thereof compressed according to the present invention;

FIG. 3-2 is similar to FIG. 3-1 but showing the compression spring released;

FIG. 14-1 is a sectional view taken along line A—A of FIG. 14.

DETAILED DESCRIPTION OF THE PREFERRED EMBODIMENT

Figure 1:
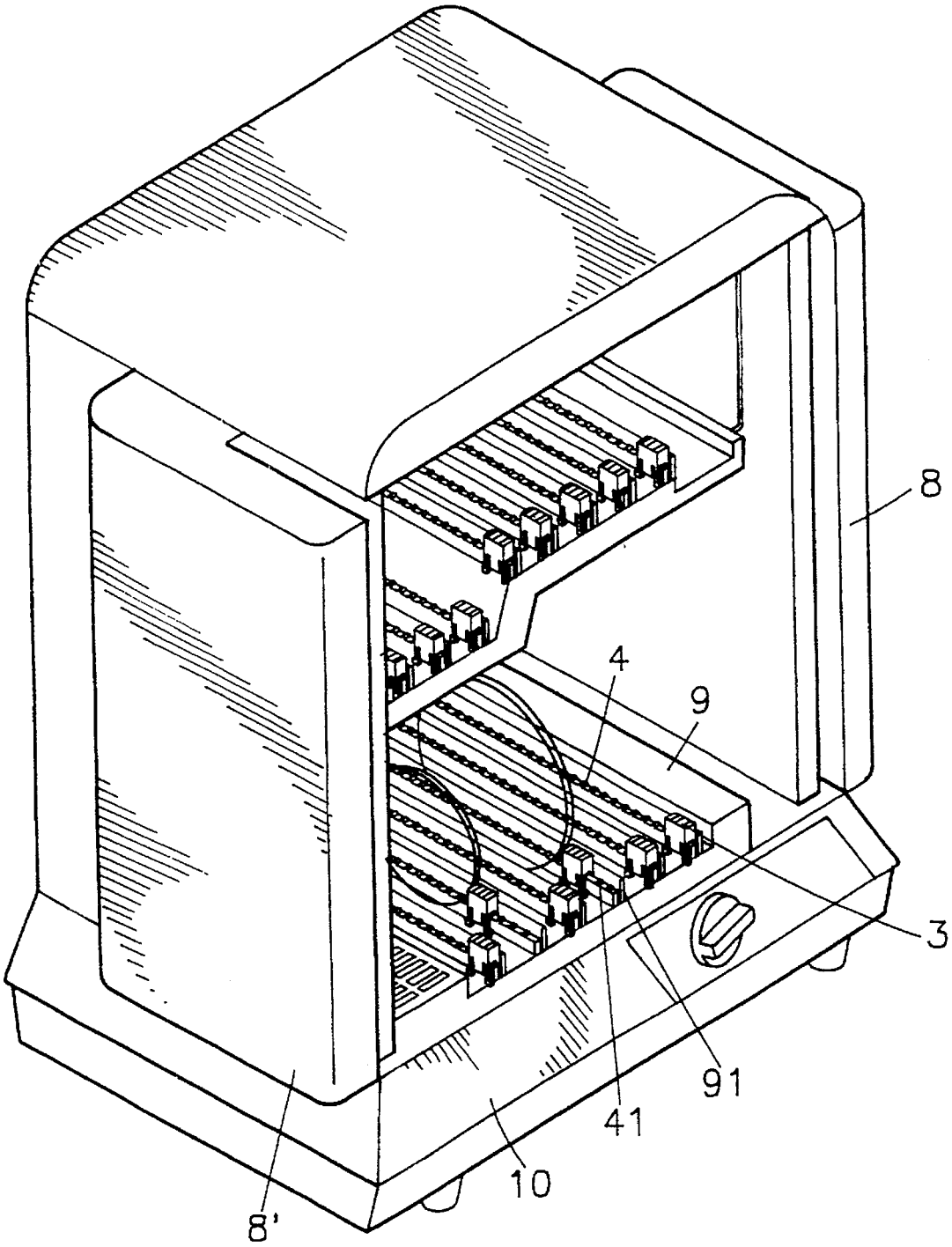
FIG. 1 is an elevational view of the the apparatus according to the present invention.

Referring to the annexed drawings in detail, the present invention comprises first and second axial compression means 1 and 1', first and second roller means 2 and 2', clamps 3, tracks 4, supporting pipes 5, air conduits 6, and an ozone generator 7.

Figure 2:
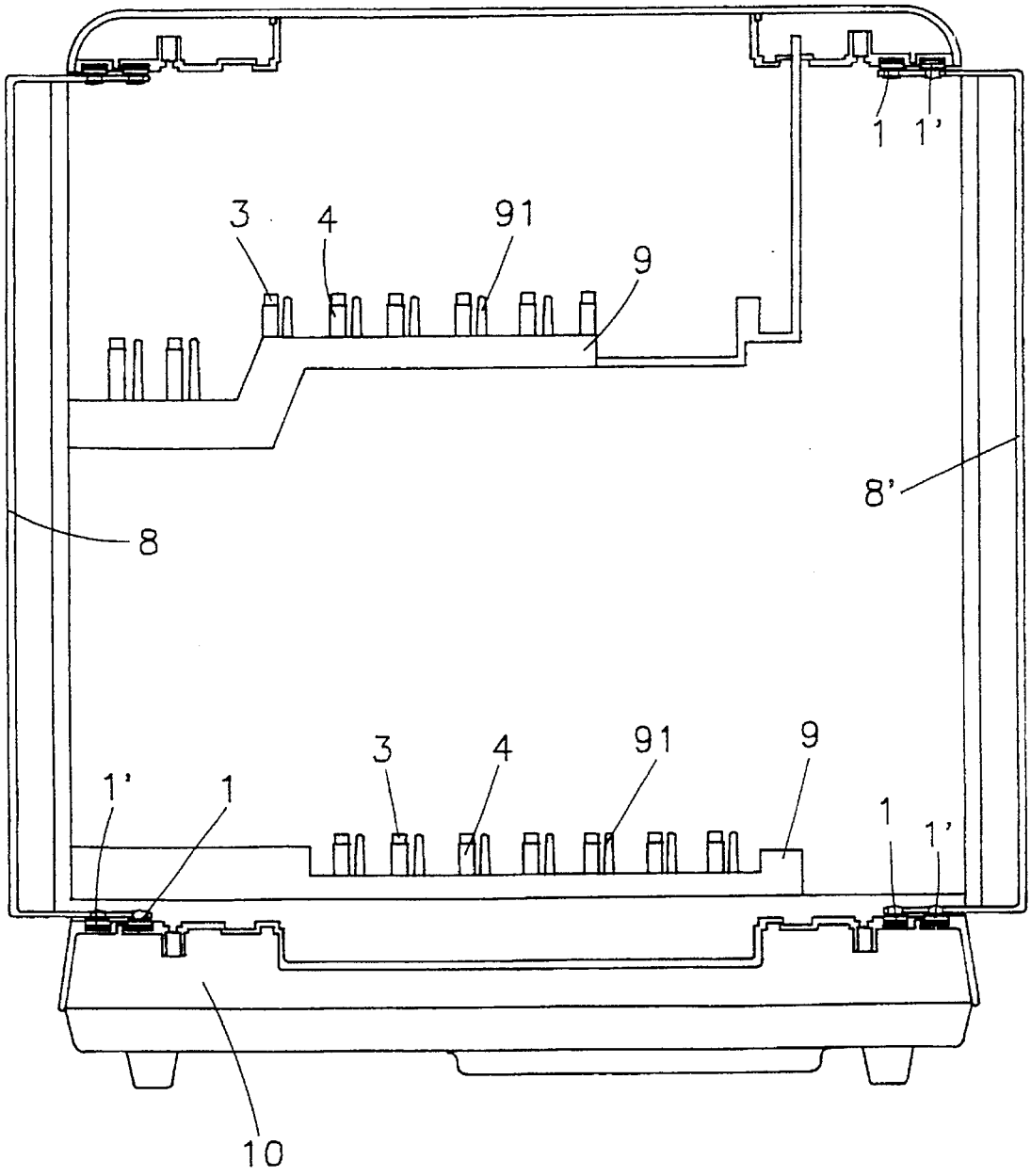
FIG. 2 is a front view in plain of the apparatus shown in FIG. 1.
Figure 3:
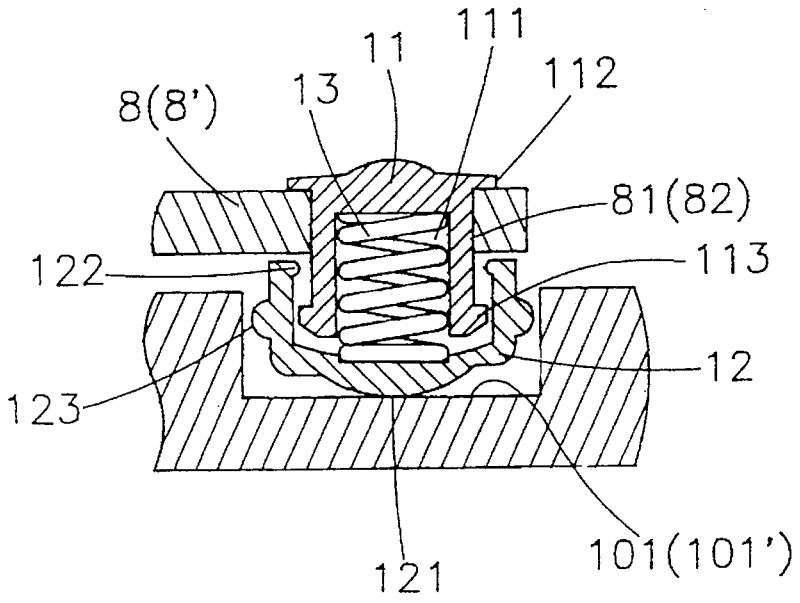
Figure 3A:
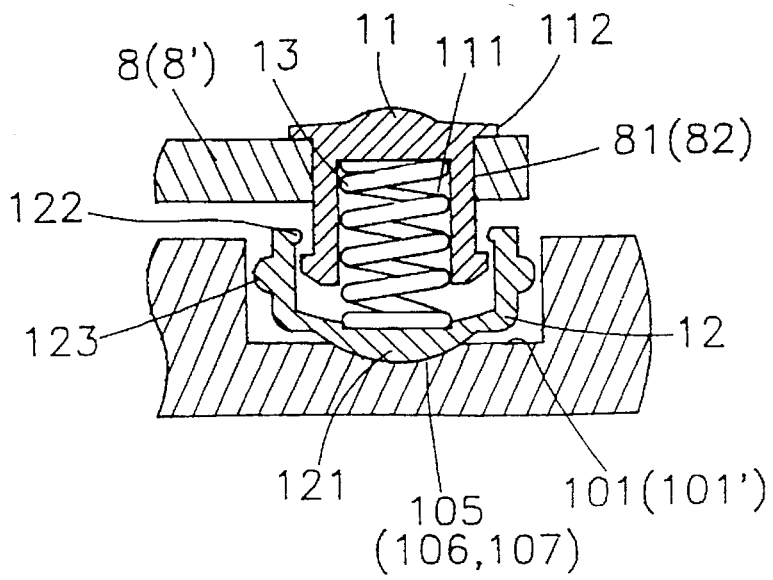

Referring to FIGS. 2, 3-1, and 3-2, the first and second axial compression means 1 and 1' are respectively mounted in respective holes 81 and 82 on two door panels 8 and 8' at two opposite ends. Each axial compression means 1 or 1' is comprised of a hollow circular base 11, a cap 12, and a compression spring 13 connected between the circular base 11 and the cap 12. The circular base 11 has a chamber 111, which receives the compression spring 13, an outward flange 112 at one end, and a hooked portion 113 at an opposite end. The cap 12 has a dome 121, a hooked portion 122 stopped against the hooked portion 113 on the circular base 11, and an outward flange 123. When the cap 12 is depressed on the circular base 11, the compression spring 13 is compressed, and the hooked portion 122 of the cap 12 is moved away from the hooked portion 113 of the circular base 11. When the cap 12 is released from hand, the cap 12 is moved away from the circular base 11, causing the hooked portion 122 of the cap 12 engaged with the hooked portion 113 of the circular base 11.

Figure 4:
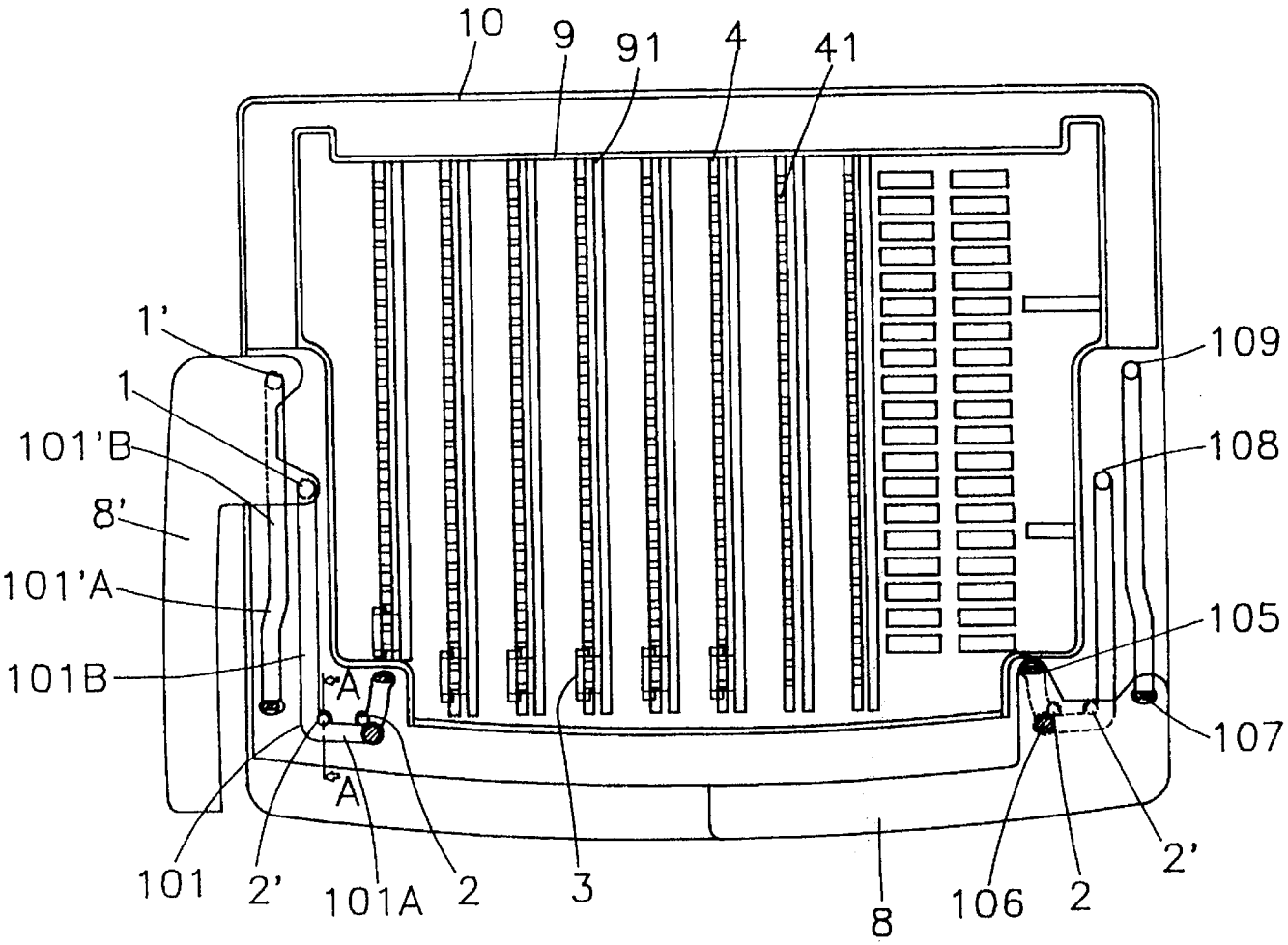
FIG. 4 is a top plain view of the apparatus shown in FIG. 1.
Figure 5:
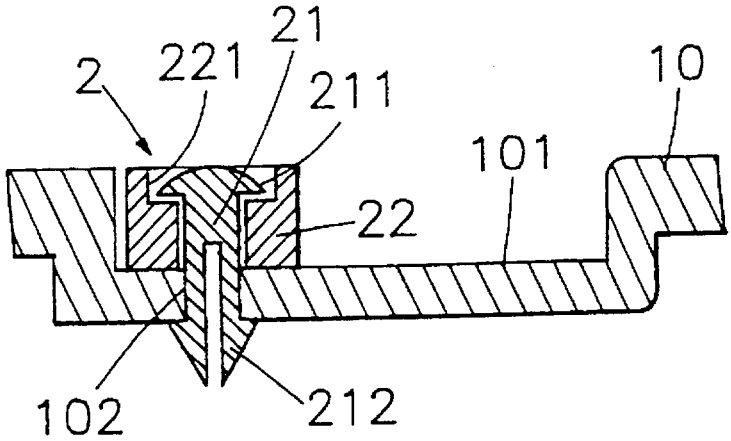
FIG. 5 is a sectional view taken along line A—A of FIG. 4.
Figure 6:
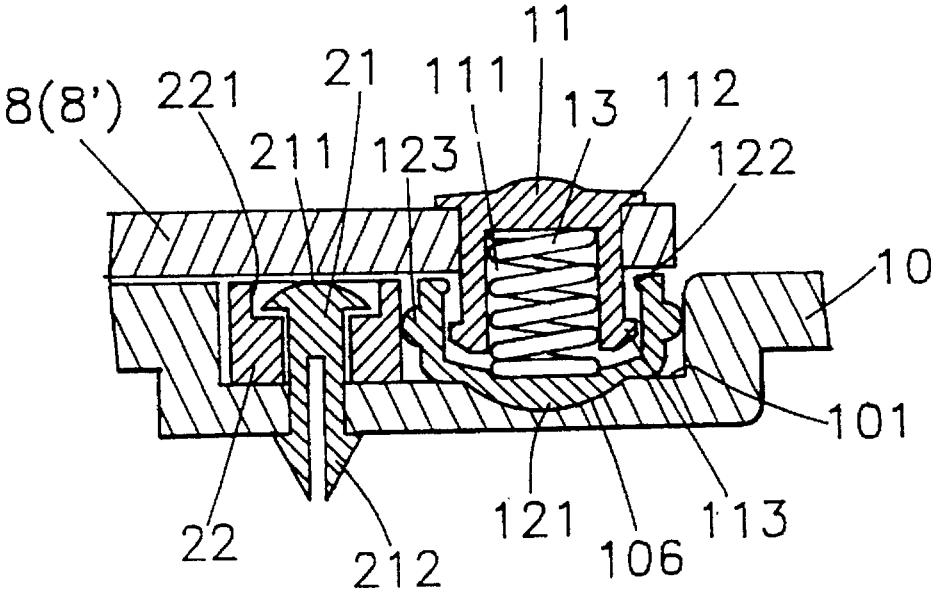
FIG. 6 shows the axial compression means passed through the respective roller means according to the present invention.

Referring to FIGS. 4 and 5, the first and second roller means 2 and 2' are respectively mounted in a through hole 102 in a first sliding groove 101 or a second sliding groove 101' on the apparatus base, referenced by 10, of the apparatus. Each roller means 2 or 2' comprises a round wheel 22, and a headed split bolt 21. The round wheel 22 has a countersunk hole 221 at the center. The headed split bolt 21 is inserted through the countersunk hole 221 on the round wheel 22 and the through hole 102 on the respective sliding groove 101 or 101', having a head 221 at one end received within the countersunk hole 221 and a split hook 212 at an opposite end disposed outside the respective through hole 102 and engaged with the bottom surface of the apparatus base 10 for permitting the round wheel 22 to be turned round the headed split bolt 21.

Figure 7:
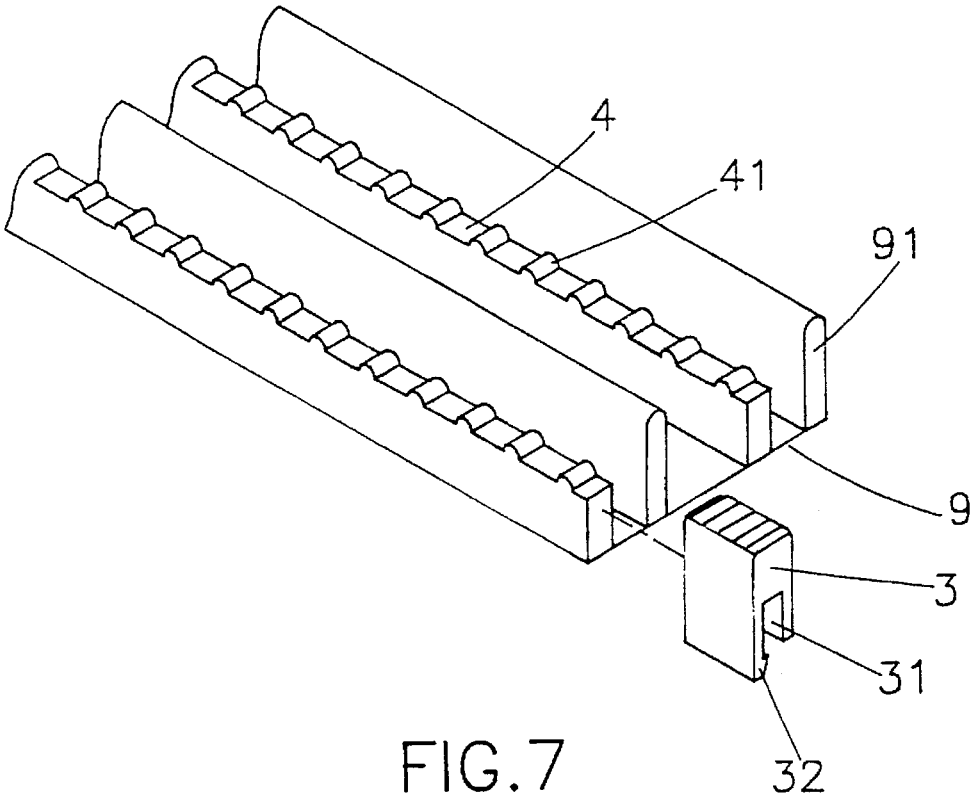
FIG. 7 shows the positioning of a clamp on a track in the rack according to the present invention.
Figure 8:
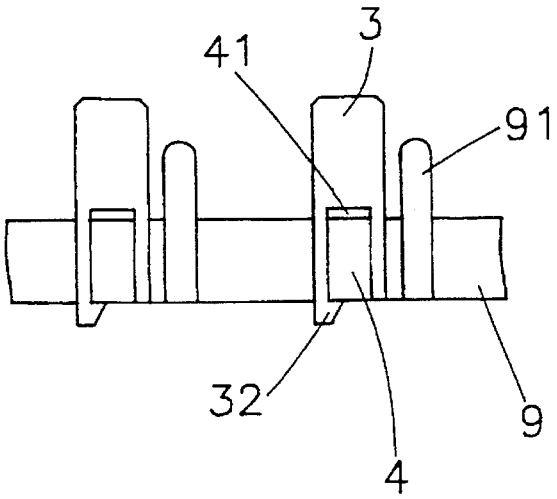
FIG. 8 is a side plain showing the clamp clamped on the track according to the present invention.

Referring to FIGS. 7 and 8, the clamps 3 are respectively made of rectangular shape, each having a bottom groove 31 engaged with the toothed top side 41 of one longitudinal track 4, which is disposed between two bars 91 on a rack 9 inside the apparatus, and two bottom hooks 32 and 32' (32' is not shown) hooked on the bottom side of the respective longitudinal track 4.

Figure 9:
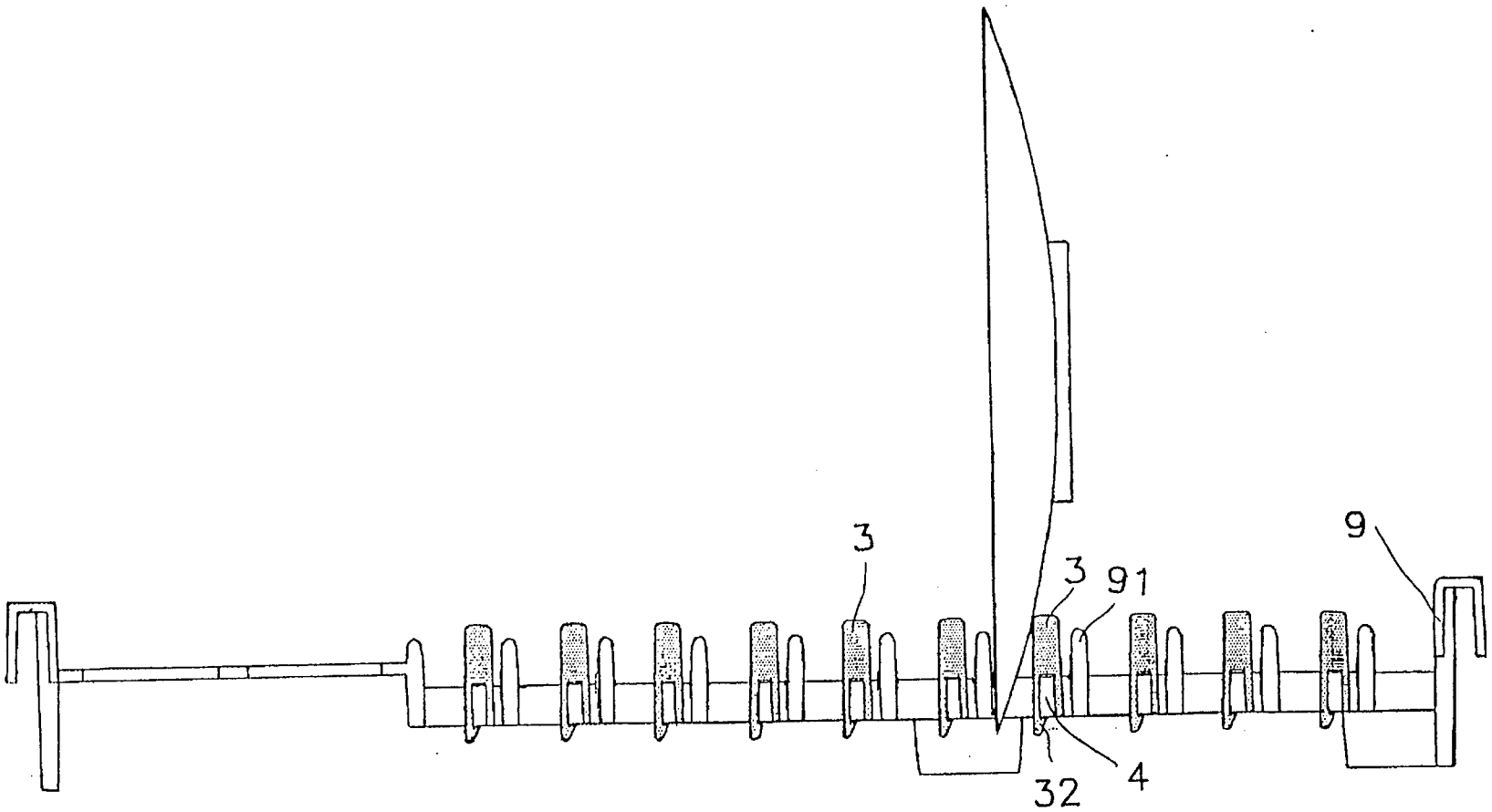
FIG. 9 is a side view of the rack showing clamps clamped on the tracks according to the present invention.
Figure 10:
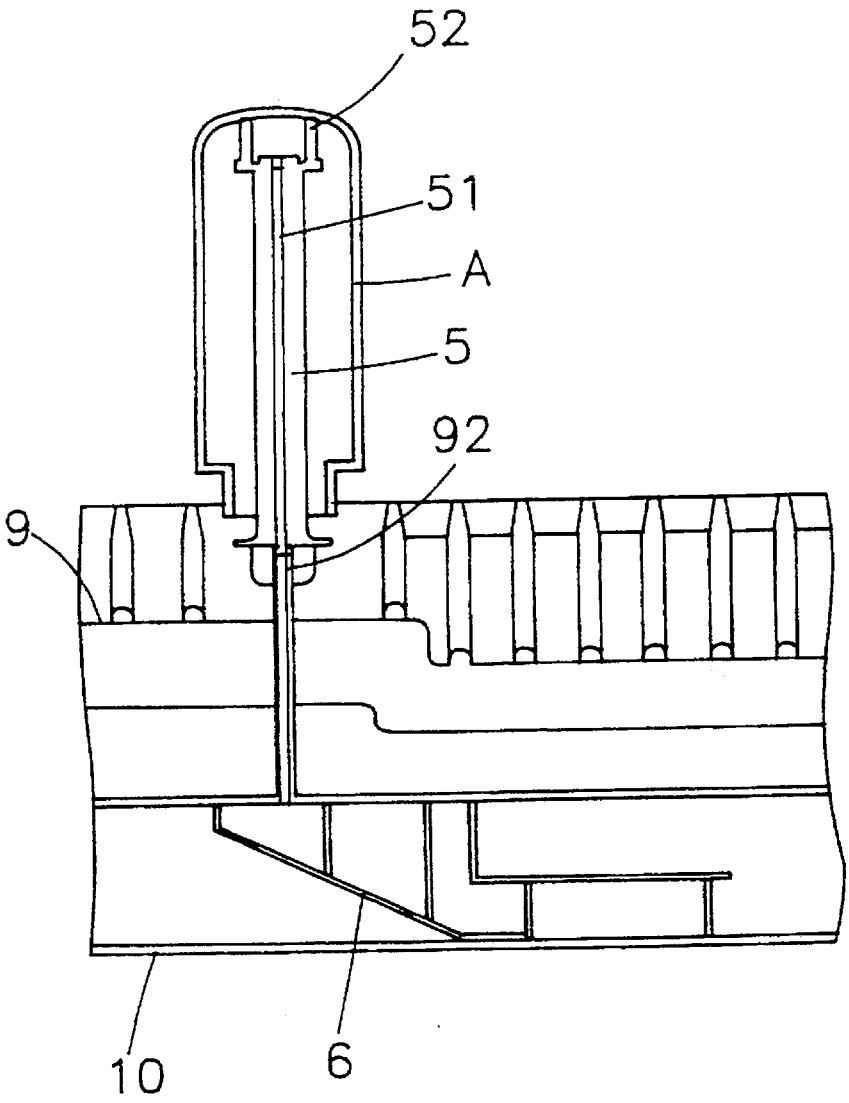
FIG. 10 is a schematic drawing showing a supporting pipe connected to a stub tube on the rack and a container supported on the supporting pipe according to the present invention.

Referring to FIGS. 9 and 10, the supporting tubes 5 are respectively connected to respective stub tubs 92 on the rack 9, each having a longitudinal center through hole 51 communicated with the respective stub tub 92, and a plurality of projecting strips 52 around the longitudinal center through hole 51 at one end remote from the rack 9.

Figure 11:
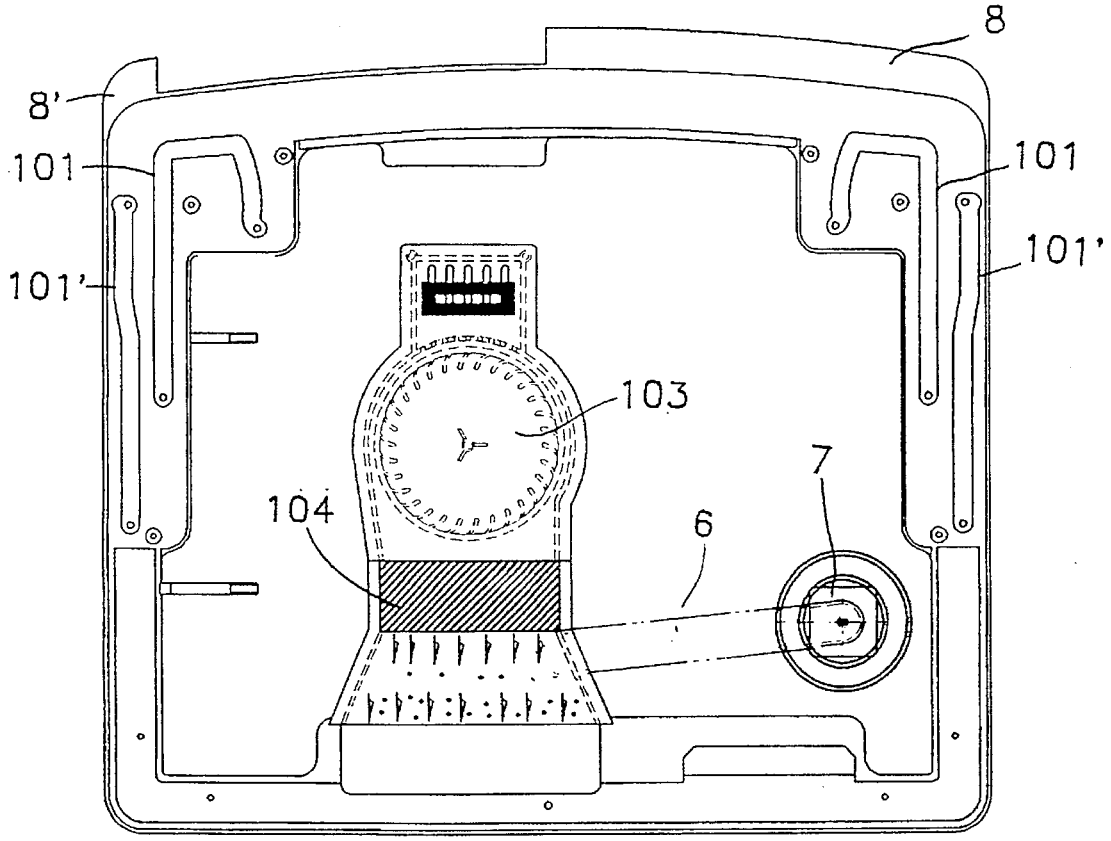
FIG. 11 shows the internal arrangement of the apparatus according to the present invention.

Referring to FIG. 11 and FIG. 10, the air conduits 6 are connected with one another and formed into a manifold for guiding ozone from the ozone generator to the rack 9.

Figure 12:
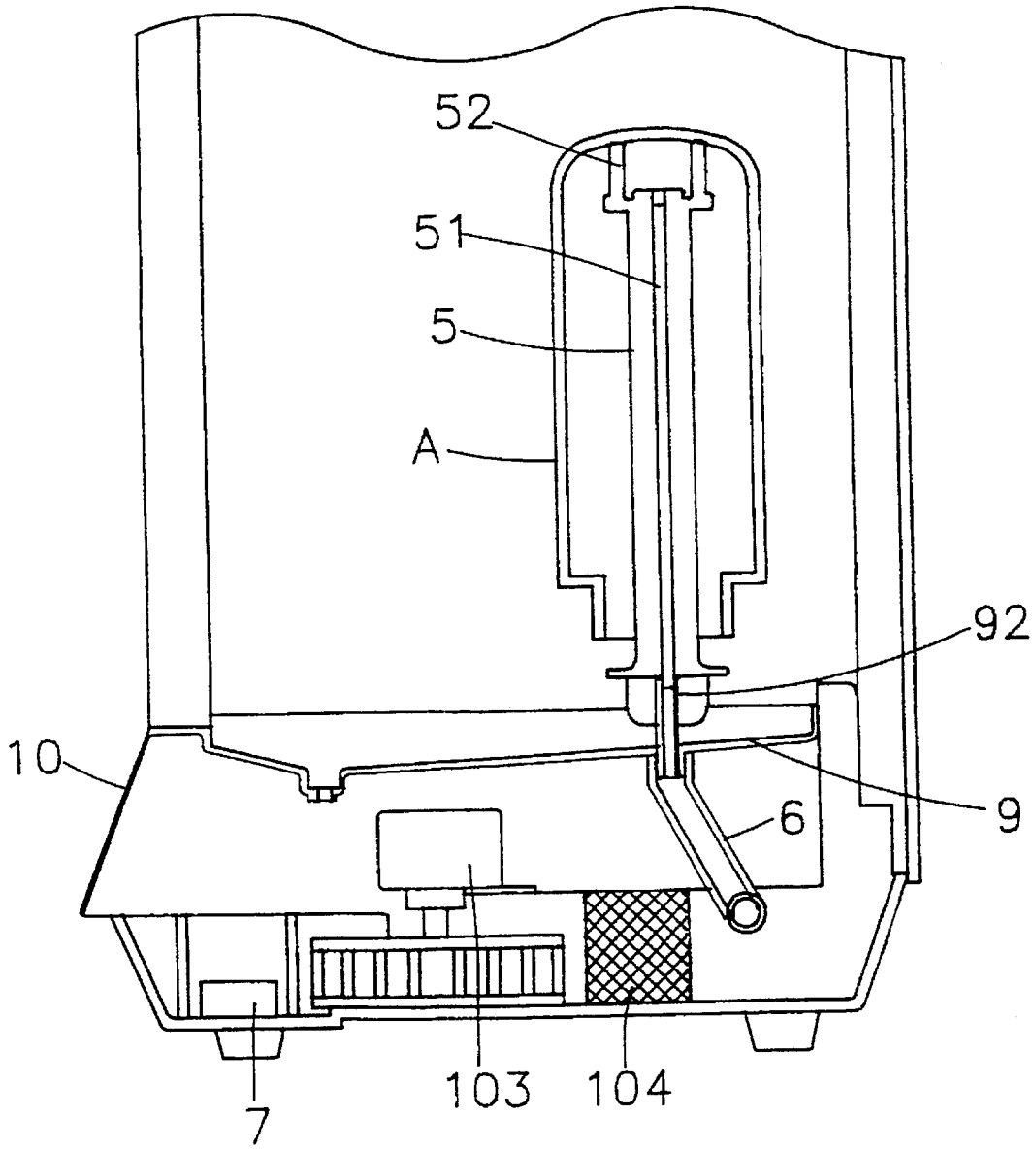
FIG. 12 shows the arrangement of the air conduits inside the apparatus according to the present invention.
Figure 13:
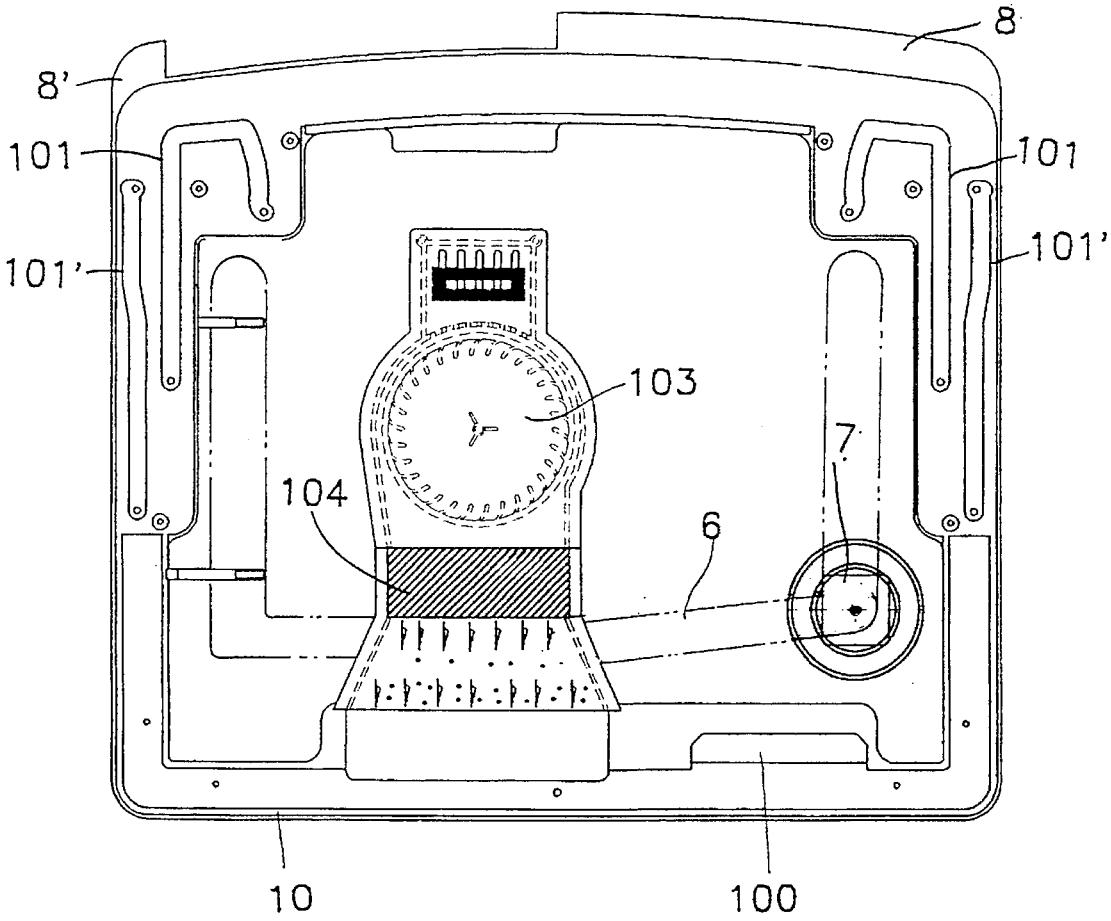
FIG. 13 shows another arrangement of the air conduits inside the apparatus according to the present invention.

Referring to FIGS. 12 and 13, the manifold-like air conduits 6 have a plurality of air outlets 61 for distribution of hot ozone through the rack 9 in all directions to heat dry and sterilize kitchen utensils, bottles, cans, containers supported on the rack 9.

Figure 14A:
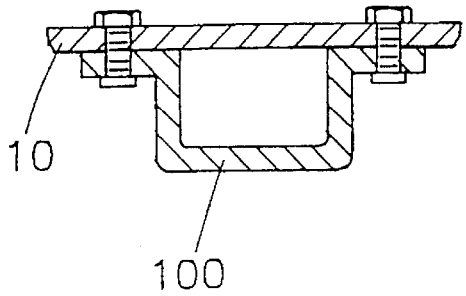
FIG. 14 is a side plain view showing the installation of the recycling pipe in the apparatus base inside the apparatus according to the present invention.
Figure 14:
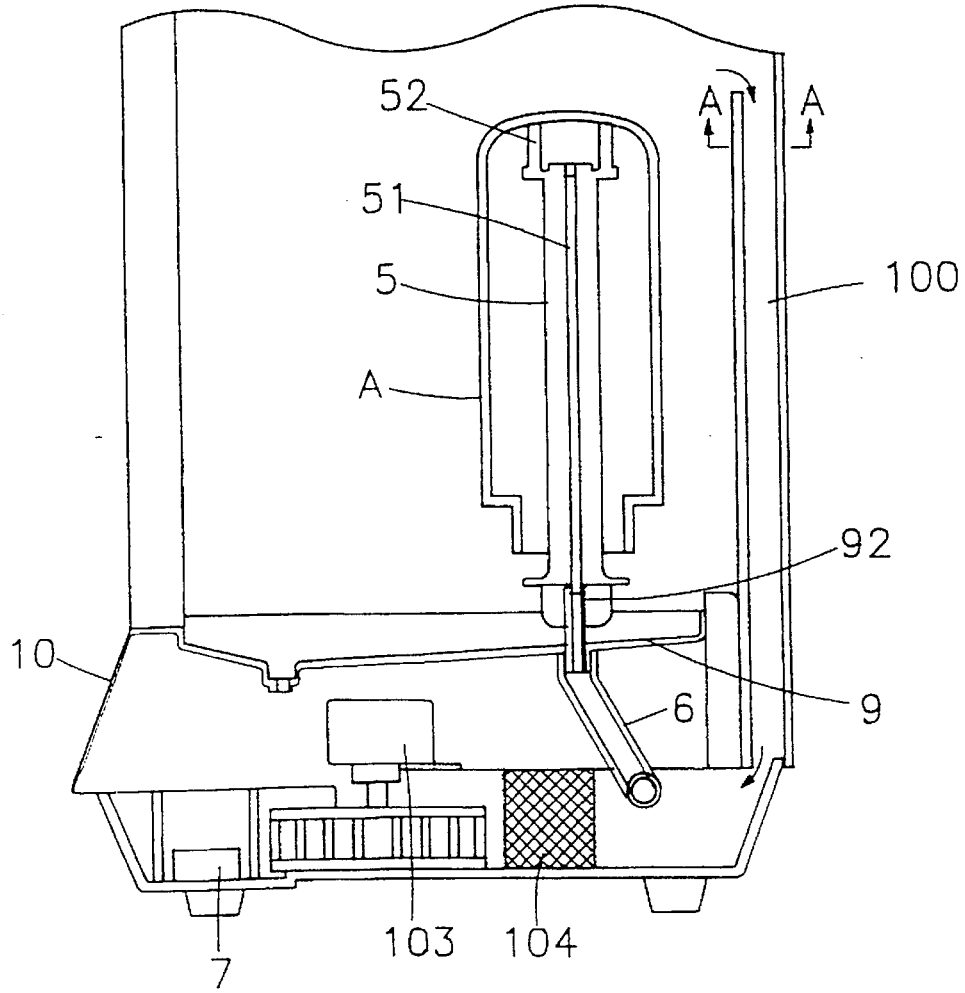

Referring to FIGS. 14 and 14-1, a hot air recycling pipe 100 is mounted on the back side of the apparatus base 10 behind the electric heater, referenced by 104, to recycle hot currents of air through the electric heater 10 for drying and sterilizing things on the rack 9 efficiently and economically.

The operation of the present invention is outlined hereinafter with referenced to the annexed drawings again.

1) 20-MINUTE KEY (a) 1st to 3rd MINUTES: The motor, referenced by 103, is operated at the low speed mode; the ozone generator 7 is started; the electric heater 104 is turned off.

(b) 4th to 19th MINUTES: the motor 103 is operated at the high speed mode; the ozone generator 7 is turned off; the electric heater 104 is turned on.

(c) The 20th MINUTE: The motor 103 is operated at the high speed mode; the ozone generator 7 is turned off; the electric heater 104 is turned off.

(d) 21th MINUTE: The motor 103 is turned off,

2) AUTOMATIC KEY (a) 1st to 3rd MINUTES: The motor 103 is operated at the low speed mode; the ozone generator 7 is turned on; the electric heater 104 is turned off.

(b) 4th to 19th MINUTES: The motor 103 is operated at the high speed mode; the ozone generator 7 is turned off; the electric heater 104 is turned on to keep the inside temperature of the apparatus within 90° C.

Referring to FIGS. 3-1, 3-2, and 4 again, a plurality of recessed holes 105, 106, and 107 are respectively made on the first and second sliding grooves 101 and 101' on the apparatus base 10 for mounting the the first and second axial compression means 1 and 1', which are fastened to the door panels 8 and 8'. Therefore, when the door panels 8 and 8' and opened, the circular caps 12 of the first and second axial compression means 1 and 1' are respectively turned in the first and second sliding grooves 101 and 101' through 360°. When the first axial compression means 1 is moved backwards to the recessed hole 106 at the turning point of the first sliding groove 101, the compression spring 13 forces the respective circular cap 12 into the recessed hole 106 for turning. When the domes 121 of the circular caps 12 of the first and second axial compression means 1 and 1' are respectively and closely disposed in contact with the first and second sliding grooves 101 and 101' and the outward flanges 123 of the circular caps 12 of the first and second axial compression means 1 and 1' are respectively disposed in contact with the round wheels 22 of the first and second roller means 2 and 2', the first and second axial compression means 1 and 1' can be turned through a certain angle and moved from the turning points 101A and 101A' of the first and second sliding grooves 101 and 101' through the straight sections 101B and 101B' to the ends 108 and 109. Similarly, when the door panels 8 and 8' are closed, the first and second axial compression means 1 and 1' are moved from the straight sections 101B and 101'B of the first and second sliding grooves 101 and 101' to the turning points 101A and 101A', and the outward flange 123 of the circular caps 12 of the first axial compression means 1 is forced to rotate the round wheel 22 of the second roller means 2', and then forced by the respective compression spring 13 into the recessed hole 106, and therefore the first and second axial compression means 1 and 1' are moved through the turning points 101A and 101A' of the first and second sliding grooves 101 and 101' to the recessed holes 105 and 107 to hold the door panels 8 an 8' in the closed position. Furthermore, the clamps 3 are respectively and adjustably mounted on the tracks 4 and engaged with the toothed top sides 41 of the tracks 4, kitchen utensils can be retained to the rack 9 among the bars 91 by the clamps 3. Furthermore, containers (for example, nursing bottles A as shown in FIG. 9) can be mounted on the projecting strips 52 of the supporting pipes 5 in the upside-down position, so that hot ozone can be guided into the inside of each container through the longitudinal center through hole 51 to dry and sterilize the inside of each container. Because a recycling pipe 100 is installed, hot ozone is recycled inside the apparatus to dry and sterilize kitchen utensils in the most efficient and economic way.

I claim:

1. An apparatus for drying kitchen utensils, comprising a first axial compression means, a second axial compression means, a first roller means, a second roller means, a plurality of clamps, a plurality of tracks, a plurality of supporting pipes, a plurality of air conduits, an ozone generator, and a hot air recycling pipe, wherein:

said first and second axial compression means are respectively mounted in respective holes on two swinging door panels on the apparatus at two opposite ends, each axial compression means comprising a hollow circular base, a cap, and a compression spring connected between said circular base and said cap, said circular base having a chamber, which receives said compression spring, an outward flange at one end, and a hooked portion at an opposite end, said cap having a dome, a hooked portion moved relative to the hooked portion of said circular base, and and outward flange around the periphery;

said first and second roller means are respectively mounted in a through hole in a first sliding groove or a second sliding groove on the apparatus base of the apparatus, each roller means comprising a round wheel and a headed split bolt, said round wheel having a countersunk hole at the center, said headed split bolt being inserted through the countersunk hole on said round wheel and the through hole on the respective sliding groove, having a head at one end received within said countersunk hole and a split hook at an opposite end disposed outside the respective through hole and engaged with the bottom side of the apparatus base of the apparatus for permitting said round wheel to be turned round said headed split bolt;

said clamps are respectively made of rectangular shape, each having a bottom groove engaged with a toothed top side on one longitudinal track, which is disposed between two bars on a rack, which is mounted inside the apparatus for carrying kitchen utensils to be dried, and two bottom hooks hooked on the bottom side of the respective longitudinal track;

a plurality of supporting tubes are respectively connected to respective stub tubs on said rack, each having a longitudinal center through hole communicated with one stub tub, and a plurality of projecting strips around the longitudinal center through hole at one end remote from said rack for supporting a container for drying;

said air conduits are connected with one another and formed into a manifold for guiding ozone from said ozone generator to said track;

said hot air recycling pipe is mounted on the apparatus base of the apparatus at a back side for collecting hot ozone being passed through said rack for recycling;

said first sliding groove and said second sliding groove each having a plurality of recessed holes for the positioning of said first and second axial compression means when said door panels are turned between the close position and the open position.

2. The apparatus of claim 1 wherein each air conduit has a plurality of air outlets for distribution of hot ozone over said rack.

* * * * *